US012552579B2

(12) United States Patent
Stowitts et al.

(10) Patent No.: US 12,552,579 B2
(45) Date of Patent: Feb. 17, 2026

(54) SEAM SEAL FOR WINE IN BEVERAGE CANS

(71) Applicant: Ball Corporation, Westminster, CO (US)

(72) Inventors: Adam Stowitts, Arvada, CO (US); Brent Trela, Superior, CO (US); Ron Burt, Golden, CO (US)

(73) Assignee: BALL CORPORATION, Westminster, CO (US)

( * ) Notice: Subject to any disclaimer, the term of this patent is extended or adjusted under 35 U.S.C. 154(b) by 963 days.

(21) Appl. No.: 17/574,131

(22) PCT Filed: Jul. 23, 2020

(86) PCT No.: PCT/US2020/043180
§ 371 (c)(1),
(2) Date: Jan. 12, 2022

(87) PCT Pub. No.: WO2021/016415
PCT Pub. Date: Jan. 28, 2021

(65) Prior Publication Data

US 2023/0264854 A1 Aug. 24, 2023

Related U.S. Application Data

(60) Provisional application No. 62/878,142, filed on Jul. 24, 2019.

(51) Int. Cl.
*B65D 25/14* (2006.01)
*B65D 17/00* (2006.01)
*B65D 17/28* (2006.01)

(52) U.S. Cl.
CPC ..... *B65D 17/08* (2013.01); *B65D 25/14* (2013.01); *B65D 17/4012* (2018.01); *B65D 2517/0061* (2013.01)

(58) Field of Classification Search
CPC ..... B65D 25/00; B65D 25/34; B65D 25/14; B21D 51/26; B21D 51/2623; B21D 51/46
(Continued)

(56) References Cited

U.S. PATENT DOCUMENTS 3,952,677 A * 4/1976 Hartman ..... B65D 15/06 220/608
4,037,550 A 7/1977 Zofko
(Continued)

FOREIGN PATENT DOCUMENTS

AU 2020315959 B2 7/2023
CH 669574 A5 3/1989
(Continued)

OTHER PUBLICATIONS

International Search Report and Written Opinion; priority document.
(Continued)

*Primary Examiner* — Anthony D Stashick
*Assistant Examiner* — Raven Collins
(74) *Attorney, Agent, or Firm* — Greer, Burns & Crain, Ltd.

(57) ABSTRACT

A can end (10) for a two-piece beverage container (1) has a public side (32) opposite a product side (34). A cured coating (76) is on the product side (34) of the can end (10) and forms a substantially continuous thin layer thereon. A circumferential curl (12) is centered about a longitudinal axis (50). A circumferential chuckwall (14) extends downwardly from the curl (12). A circumferential U-shaped countersink (16) is located downwardly from the chuckwall (14). The countersink (16) has an annular bead defining a lowermost vertical extent of the can end (10). A center panel (18) is located radially inwardly from the countersink (16) and is centered about the longitudinal axis (50). The center panel (18) has a
(Continued)

means for providing an opening in the can end (10). A circumferential second coating (92) forms an annular layer on the product side (34) of the circumferential curl (12) and the cured coating (76). The second coating (92) provides a layer on one or more fractures in the cured coating (76).

28 Claims, 14 Drawing Sheets

(58) Field of Classification Search
USPC ..... 113/120; 220/610, 619
See application file for complete search history.

(56) References Cited

U.S. PATENT DOCUMENTS

| | | | | |
|---|---|---|---|---|
| 4,692,132 | A * | 9/1987 | Ikushima | B65D 3/22 493/110 |
| 8,328,493 | B2 | 12/2012 | Gogola et al. | |
| 2005/0029269 | A1 | 2/2005 | Stodd et al. | |
| 2013/0306658 | A1* | 11/2013 | Watson | B65D 25/00 220/610 |
| 2013/0309043 | A1 | 11/2013 | McClung et al. | |
| 2016/0236825 | A1 | 8/2016 | Mijatovic | |
| 2019/0048300 | A1 | 2/2019 | Gatewood et al. | |
| 2023/0264854 | A1 | 8/2023 | Stowitts et al. | |

FOREIGN PATENT DOCUMENTS

| | | | |
|---|---|---|---|
| EP | 4003854 | B1 | 6/2022 |
| GB | 499902 | A | 1/1939 |
| GB | 968966 | A | 9/1964 |
| WO | 2006050465 | A1 | 5/2006 |
| WO | 2019032872 | A1 | 2/2019 |

OTHER PUBLICATIONS

Argentina Office Action for corresponding Argentina Patent Application No. 20200102057 dated Aug. 22, 2023.
Mexican Office Action for corresponding Mexican Patent Application No. MX/a/2022/000700 dated Mar. 24, 2025.

* cited by examiner

SEAM SEAL FOR WINE IN BEVERAGE CANS

CROSS-REFERENCE TO RELATED APPLICATIONS

This Application is a United States National Stage Application under 35 U.S.C. Section 371 of International Patent Application No. PCT/US2020/043180 filed on Jul. 23, 2020, which is hereby incorporated by reference as if fully set forth herein. This Application also claims priority to and the benefit of U.S. Provisional Application No. 62/878,142, filed on Jul. 24, 2019, which is also hereby incorporated by reference as if fully set forth herein.

FEDERALLY SPONSORED RESEARCH OR DEVELOPMENT

N/A

TECHNICAL FIELD

The invention relates to beverage containers; more particularly, the invention relates to the attachment of can ends onto can bodies.

BACKGROUND OF THE INVENTION

For some time, beverage makers have stored and marketed fermented beverages, such as wine and cider, in aluminum-based containers. Increasingly, beverage marketers have turned to the popular two-piece, stay-on tab aluminum beverage cans, billions of which are produced each year. However, some challenges remain in storing such beverages in these containers.

For example, in some cases, certain beverages, such as wine, develop an undesirable taste which has been attributed to the containers. It is believed that one cause of the undesirable taste is an aroma of hydrogen sulfide produced by acid corroding the aluminum container in the presence of sulfur dioxide.

To combat corrosion, container inner surfaces, commonly called the product side, include a resilient film formed by a cured coating. Typically, the film is formed by spray coating the container components, typically with a coating, such as an epoxy-based organic protective coating, although bases other than epoxy are also available. These coatings may be from the following classes of material: water-based, solvent-based, 100% solids, low VOC, energy cured (including UV, LED and electron beam), bisphenol A non-intent (BPAni) polyester, BPAni acrylic, and BPAni polyurethane, electrostatic (powder), and low-styrene. Examples of suitable coatings are INNOVEL® epoxy coating marketed by PPG, CANVERA™ polyolefin dispersion coating marketed by Dow Chemical, METPOD 100 polyolefin dispersion coating marketed by Metlac Group, valPure® V70 Series BPAni coating marked by Valspar Corporation, and AQUALURE™ BPAni coating marketed by Akzo-Nobel.

The product side of a can body is typically spray coated. The coating is then cured to form the resilient film.

Alternatively, can bodies may be roll coated with a coating or have a laminate film applied. The metal strip used to produce can ends is generally roll coated prior to the can ends being formed from the metal strip. These coatings are intended to prevent the beverage from contacting or reacting with the metal of the inner surface of the can ends and bodies by providing a film between the metal and the beverages.

The film is resilient in that it able to withstand immediate attack by the beverage without decomposing to form fractures and/or voids in the film.

Referring to FIGS. 1 and 2, a beverage container 1 is formed by a can end 10 attached to an open end of a can body 40 in a process called double seaming after the can body 40 has been filled with a beverage. The seaming process typically requires the can body 40 and the can end 10 to be elevated and clamped between a base plate and a seaming chuck. A first set of seaming rollers 48 is rotated about the seaming chuck 44 along the open end of the can body 40 with sufficient pressure to form a first portion of a double joining seam. When the first step in forming the double seam 4 has been completed, the first pair of opposed seaming rollers 48 is retracted, and the seaming rollers of a second pair 52 are actuated to complete the double seam 4. When the seaming of the can end 10 to the can body 40 is complete, the second set of seaming rollers 52 is retracted, and a base plate piston is retracted. At the same time, a seamer knockout piston carried centrally of the seaming chuck 44 is actuated striking the exposed outer surface of the can end 10 to ensure freeing of the sealed container 1 from the chuck 44 to complete the seaming operation.

In typical double-seamed containers, a seaming or sealing compound is applied to the can end 10 in the region of a seaming curl 12. Typically, the sealing compound is a liquid polymer dispersion. A bead of the sealing compound is applied to the seaming curl 12 to create a hermetic seal when the can end 10 is attached to a can body 40 by the double seamer. These sealing compounds can be water-based or solvent-based. The sealing compound flows during double seaming so as to fill up any spaces that may exist between the can end 10 and can body 40 in the seam area.

The double seaming process can result in scratches on beverage contacting surfaces of the can end 10 and/or the can body 40. These scratches, if aggressive enough, can locally remove some or all of the protective coating applied to the beverage contacting surfaces of the container 1. Similarly, the bending during the seaming operation could cause the coating of the can ends 10 and can bodies 40 to fracture. The fracturing could locally thin, weaken, or remove the protective coating on the can ends and can bodies. Likewise, a necking/flanging operation during the production of the can body can also cause scratching or fracturing of the protective coating prior to seaming. It is believed that the localized scratching and/or fracturing could provide initiation sites for corrosion, which risk is increased by the relatively aggressive nature of the fermented beverages stored therein.

The present invention is provided to solve the problems discussed above and other problems, and to provide advantages and aspects not provided by prior packaging of wine and the like in metallic containers of this type. A full discussion of the features and advantages of the present invention is deferred to the following detailed description, which proceeds with reference to the accompanying drawings.

SUMMARY

A first aspect of the invention is directed to a can end for a two-piece beverage container, the can end comprising:

- a public side opposite a product side;
- a cured coating on the product side of the can end forming a substantially continuous thin layer thereon;
- a circumferential curl centered about a longitudinal axis;

a circumferential chuckwall extending downwardly from the curl;

a circumferential U-shaped countersink located downwardly from the chuckwall, the countersink having an annular bead defining a lowermost vertical extent of the can end;

a center panel located radially inwardly from the countersink and centered about the longitudinal axis, the center panel comprising a means for providing an opening in the can end; and a circumferential second coating forming an annular layer on the product side of the circumferential curl and the cured coating, the second coating providing a layer on one or more fractures in the cured coating.

The first aspect of the invention may include one or more of the following features, alone or in any reasonable combination. The second coating may extend from the curl downwardly on the chuckwall towards the countersink and terminate at a height on the can end greater than a lowermost vertical extent of the can end. The second coating may terminate at a height on the can end that is no greater than 6 mm above the lowermost vertical extent of the can end. The second coating may terminate at a height on the can end between 5 mm and 6 mm above the lowermost vertical extent of the can end. The second coating may terminate at a height on the can end between 5.25 mm and 5.6 mm above the lowermost vertical extent of the can end. The second coating may be a sealing compound applied to the can end subsequent to forming and prior to seaming the can end to a can body. The one or more fractures may create a void which exposes a bare metal through the cured coating. The cured coating is an organic coating. The second coating may have a weight greater than 18 mg. The second coating may have a weight between 18 mg and 32 mg. The second coating may have a weight between 24 mg and 32 mg. The can end may be produced from aluminum.

A second aspect of the present invention is directed to a beverage container comprising:

a metallic can end comprising a curl defining an outer perimeter of the can end, the can end having a product side opposite a public side;

a metallic can body comprising a flange about an open end, the can body also having a product side opposite a public side, wherein the curl of metallic can end is seamed with the flange to form a double seam enclosing the beverage container;

a gap between the can end and can body below the double seam forming a distance between the product side of the can end and the product side of the can body; and a sealing compound on at least one of the can end and the can body and extending into the gap.

The second aspect of the invention may include one or more of the following features, alone or in any reasonable combination. The can end may comprise a circumferential U-shaped countersink located downwardly from the curl, the countersink having an annular bead defining a lowermost vertical extent of the can end, wherein sealing compound extends into the gap and terminates at a height greater than a lowermost vertical extent of the can end. The sealing compound may terminate within the gap at a height no greater than 6 mm above the lowermost vertical extent of the can end. The sealing compound may terminate within the gap at a height between 5 mm and 6 mm above the lowermost vertical extent of the can end. The sealing compound may terminate within the gap at a height between 5.25 mm and 5.6 mm above the lowermost vertical extent of the can end. The sealing compound may be applied to the can end subsequent to forming and prior to seaming the can end to a can body. The sealing compound may provide a layer on one or more fractures in a cured coating on at least one of the can end and the can body. The one or more fractures may create a void which exposes a bare metal to the sealing compound. The cured coating may be an organic coating. The sealing compound may have a weight greater than 18 mg. The sealing compound may have a weight between 18 mg and 32 mg. The sealing compound may have a weight between 24 mg and 32 mg. The can end and the can body may be produced from aluminum. The can end may have a countersink depth measured from an uppermost vertical extent of the curl to the public side of a lowermost vertical extent of the countersink, and the sealing compound may terminate at a height above the lowermost vertical extent of the product side of the can end that is 75% to 90 of the countersink depth. The gap between the can end and the can body may be within a containment space of the beverage container which holds a liquid beverage and is created by the product sides of the can end and can body. The gap may be located radially inwardly from the double seam relative to a longitudinal axis about which the beverage container is centered. The gap may form a distance between the product side of the can end and the product side of the can body. An uppermost portion of the containment space may be defined by a region of the beverage container located radially inwardly from the double seam where the product side of the can body and the product side of the can end begin to diverge from one another.

A third aspect of the invention is directed to a beverage container comprising:

a metallic can end comprising:

a public side opposite a product side;

a first cured coating on the product side of the can end forming a substantially continuous thin layer thereon;

a circumferential curl centered about a longitudinal axis;

a circumferential chuckwall extending downwardly from the curl;

a circumferential U-shaped countersink located downwardly from the chuckwall; and a center panel located radially inwardly from the countersink and centered about the longitudinal axis comprising:

a tab on the public side of the can end having a lift end opposite a nose end;

a rivet attaching a tab to the center panel;

a tear panel on the public side of the can end defined by a frangible score and a non-frangible hinge that joins a first end of the frangible score with a second end of the frangible score, a metallic can body comprising:

a public side opposite a product side;

a second cured coating on the product side of the can body forming a substantially continuous thin layer thereon;

a generally cylindrical sidewall;

a reduced diameter neck joined to the sidewall through a shoulder of progressively decreasing diameter;

a radially outwardly curled flange; and a bottom portion enclosing the sidewall and integral therewith a double seam joining the curl of the can end to the flange of the can body;

voids in at least one of the first cured coating and the second cured coating; and a sealing compound located between the can end coating and the can body coating creating a protective layer over the voids and extending downwardly towards the bottom portion into a gap between the public side of the can end and the can body creating a space therebetween.

The third aspect of the invention may include one or more of the following features, alone or in any reasonable combination. The gap between the can end and the can body may be within a containment space of the beverage container which holds a liquid beverage and is created by the product sides of the can end and can body. The gap may be located radially inwardly from the double seam relative to the longitudinal axis about which the beverage container is centered. The gap may form a distance between the product side of the can end and the product side of the can body. An uppermost portion of the containment space may be defined by a region of the beverage container located radially inwardly from the double seam where the product side of the can body and the product side of the can end begin to diverge from one another.

A fourth aspect of the invention is directed to a can body for a two-piece beverage container, the can body comprising:

a product side opposite a public side;

a lower portion comprises:

an enclosed bottom; and a cylindrical sidewall extending upwardly from the enclosed bottom portion, the cylindrical sidewall centered about a longitudinal axis;

an upper portion comprises:

a circumferential shoulder portion integral with an uppermost portion of the cylindrical side wall, the circumferential shoulder smoothly tapered radially inwardly;

a circumferential neck extending upwardly from an uppermost portion of the circumferential shoulder; and an open end connected to the circumferential neck, the open end having a flange curled radially outwardly in relation to the longitudinal axis;

a cured coating forming a substantially continuous thin layer on the product side of can body; and a second coating forming a circumferential layer on the flange and extending downwardly on the neck.

The fourth aspect of the invention may include one or more of the following features, alone or in any reasonable combination. The circumferential layer may terminate above the shoulder. The circumferential layer may engage a bare metal of the product side of the can body through one or more voids in the cured coating. The circumferential layer may form a layer of one or more fractures in the cured coating.

A fifth aspect of the present invention is directed to a method of sealing a fermented beverage in a metallic beverage container. The method comprises the steps of:

providing a metallic can end comprising a curl defining an outer perimeter of the can end, the can end having a product side opposite a public side, the can end provided with a first cured coating forming a resilient film on the product side of the can end;

providing a metallic can body comprising a flange about an open end, the can body also having a product side opposite a public side, the can body provided with a second cured coating forming a resilient film on the product side of the can body;

applying a flowable sealing compound between the can end and the can body;

attaching the can end to the can body by a double seam wherein the flowable sealing compound is located within the double seam and extends into a gap defined by a space between the product side of the can body and the can end.

The fifth aspect of the invention may include one or more of the following features, alone or in any reasonable combination. The gap between the can end and the can body may be within a containment space of the beverage container which holds a liquid beverage and may be created by the product sides of the can end and can body. The gap may be located radially inwardly from the double seam relative to the longitudinal axis about which the beverage container is centered. The gap may form a distance between the product side of the can end and the product side of the can body. An uppermost portion of the containment space may be defined by a region of the beverage container located radially inwardly from the double seam where the product side of the can body and the product side of the can end begin to diverge from one another. At least one of the first cured coating and the second cured coating may comprise fractures, and the method may further comprise applying a layer of the sealing compound on the fractures within the gap. At least one of the fractures may create a void in the at least one of the first cured coating and the second cured coating. The void may expose a bare metal within the gap wherein the method may further comprise applying a layer of the sealing compound on the void within the gap to cover the bare metal. The sealing compound may terminate within the gap at a height no greater than 6 mm above a lowermost vertical extent of the can end. The sealing compound may terminate within the gap at a height between 5 mm and 6 mm above the lowermost vertical extent of the can end. The sealing compound may terminate within the gap at a height between 5.25 mm and 5.6 mm above the lowermost vertical extent of the can end. The sealing compound may terminate at a height above the lowermost vertical extent of the product side of the can end that is 75% to 90 of the countersink depth.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
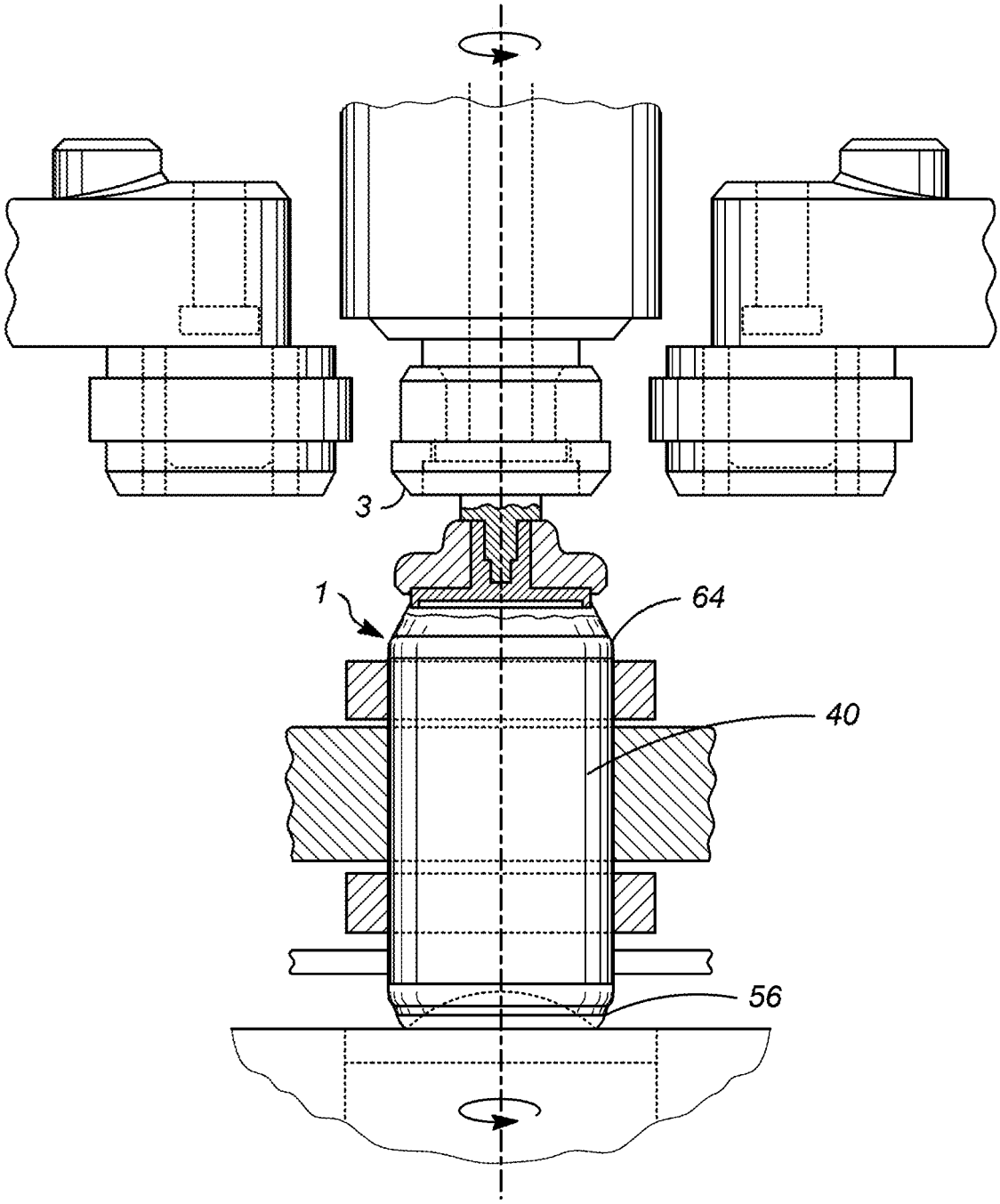
FIG. 1 is a side view of a seaming operation in which a can end or lid is attached to a can body by a double seam.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention includes placing a material, such as a sealing compound, in select locations specifically forming a liner to protect a fermented beverage product, such as a wine product produced from grapes, from any unintended damage to the product side surfaces of the container components, such as can ends and can bodies. Manufacturers of such sealing compounds include Altana and Henkel. A specific example of a sealing compound is marketed under the name DAREX® by Henkel. Suitable sealing compounds for use in the present invention exhibit a density at 20° C. (68° F.) of 1.06 g/cm$^3$ (8.846 lbs./gal) and a viscosities between 550 mPa-s and 4500 mPa-s. The viscosity of the sealing compounds generally have a greater viscosity than the uncured coatings supplied to the product sides of beverage container can ends and can bodies.

The present invention also includes placing a material, such as a sealing compound, in select locations on or between can ends and can bodies to specifically protect against a fermented beverage product, such as a wine product, from contacting uncoated surfaces of the can ends and can bodies subsequent to or during a seaming operation. This is referred to as full coverage compound seam seal can ends in the unseamed condition (not attached to a can body) and full compound coverage seam seal containers when seamed (attached) to a filled container. The seaming operation attaches a given can end to a given can body. The material prevents the fermented beverage product from engaging uncoated surfaces of the can ends and can bodies subsequent to and during the seaming operation. Testing has shown a correlation between the severity of corrosion around the seam and sulfur aroma intensity.

Thus, an aim of the present invention is to prevent or seal a wine product from contacting bare metal surfaces of the container components, which surfaces received coating-removing damage during a necking/flanging, conveyance on track work, and/or seaming operation processes.

It is know that metal exposed to wine causes $H_2S$. It is also known that aggressive metal forming during the process of attaching a can end onto a can body can cause coating damage and localized metal exposure. The present disclosure includes positioning a sealing compound in the form of a liner on can ends in a discrete, full coverage compound seam seal (FCCSS) position to cover metal exposure sites.

Current product side coating is not always durable enough to withstand forming at a necking/flanging station but flexible enough to be seamed. Utilizing an additional volume of sealing compound, which is normally used in the seaming operation to ensure a seal between the can end and the can body, limits or reduces the demand on the integrity of the product side coating material.

A method of the present invention comprises extending a volume of a sealing compound downwardly from a sealing curl of the can end, along and downwardly on the chuckwall towards a generally U-shaped countersink of the can end, terminating above or just above the annular curved portion located at the bottom of the countersink. This additional volume of sealing compound protects the more brittle product side coating coating/substrate.

The inventors have verified that the cured organic protective coating on the product sides of the container components exhibits fractures when applied to aluminum container bodies and can ends that undergo further processing subsequent to coating. This typically does not pose a concern or problem in most beverage industries. However, aluminum containers holding fermented beverages, e.g., wine in particular, require an additional level of protection due to the beverage's aggressive corrosive effect on the metallic aluminum. The inventors identified a portion of the container prone to this corrosive attack and developed a standardized testing to confirm their findings.

The invention relates to modifying materials (i.e. volume and location of application) and a cure process, for example solvent, radiation, ultraviolet light, and thermal cures, to gain the characteristics needed to best protect the wine product from exposed aluminum.

The invention also relates to using a sealing compound in a new, currently non-standard method to improve the taste and shelf life of fermented beverages stored in aluminum two-piece containers.

Figure 3:
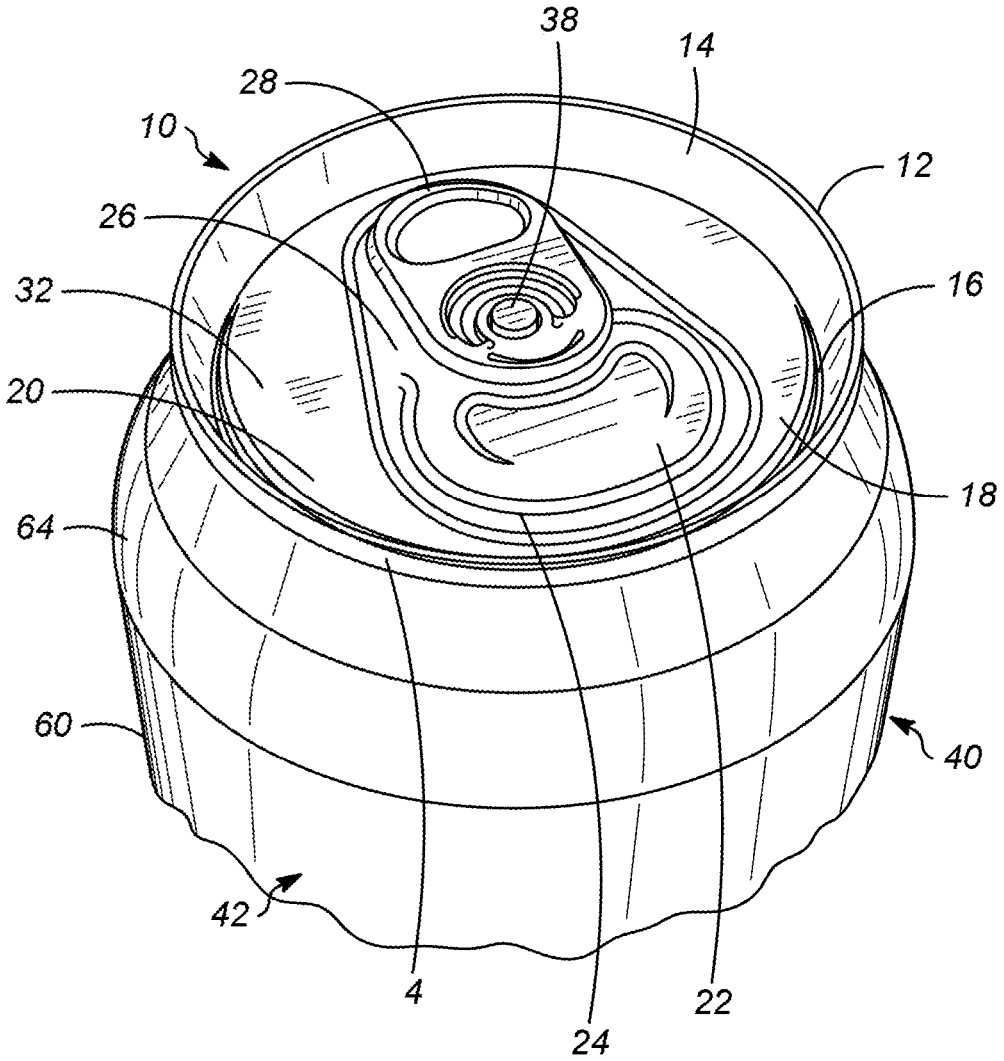
FIG. 3 is a partial view of a can end attached to a can body to form a beverage container.
Figure 4:
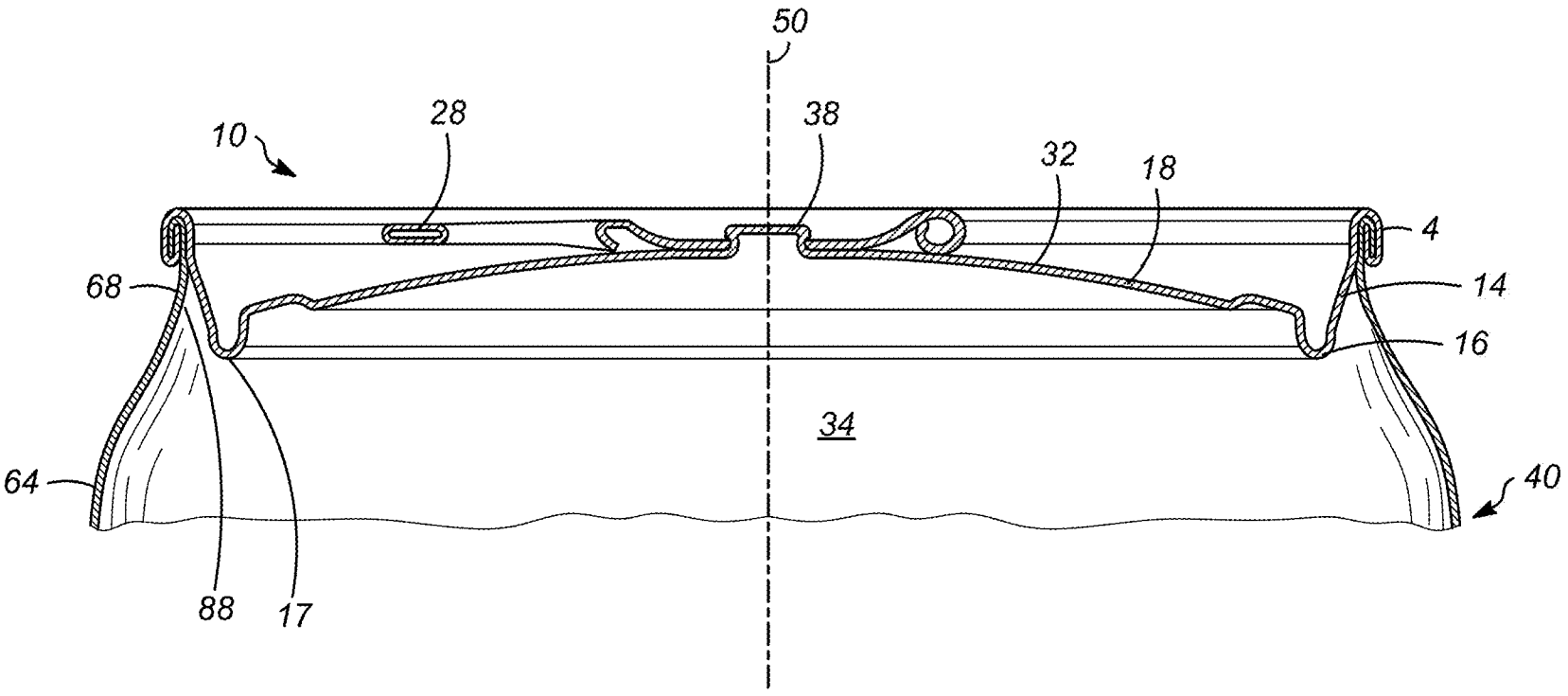
FIG. 4 is a partial cross-sectional view of a beverage container.
Figure 5:
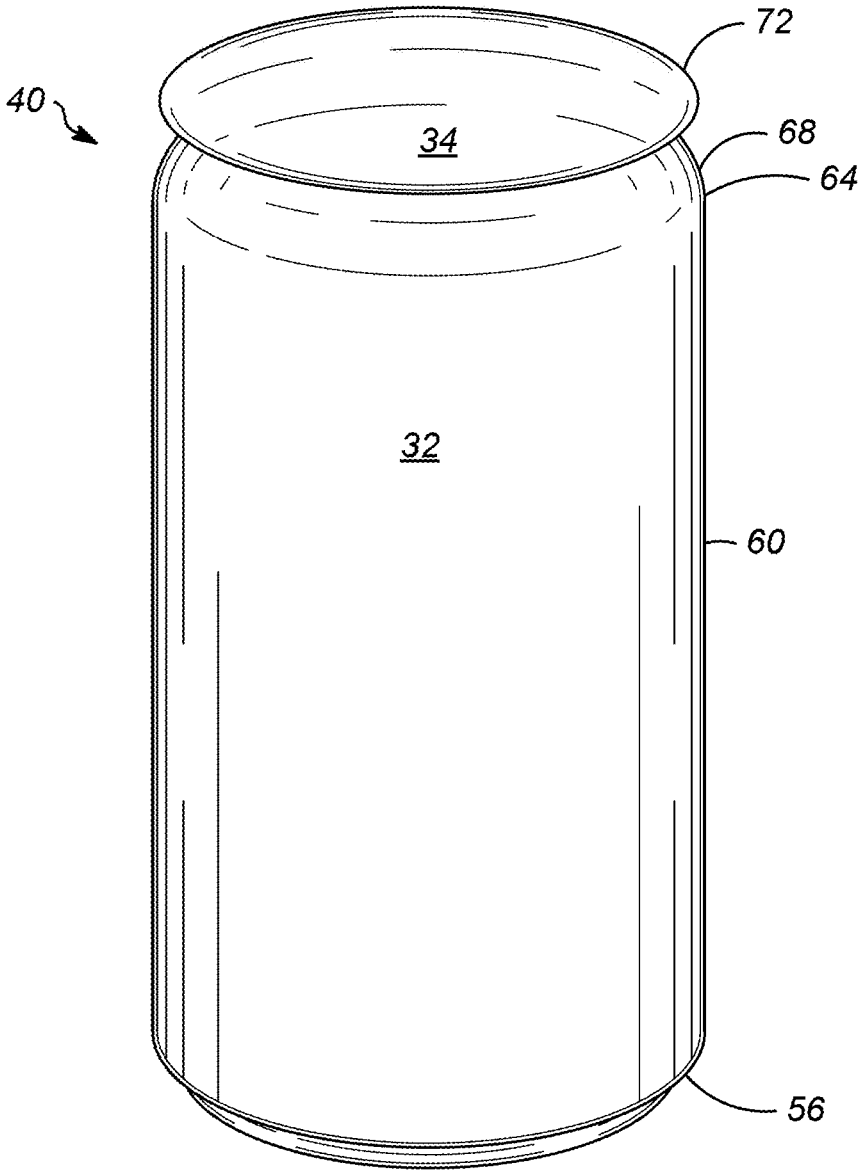
FIG. 5 is a view of a can body.
Figure 6:
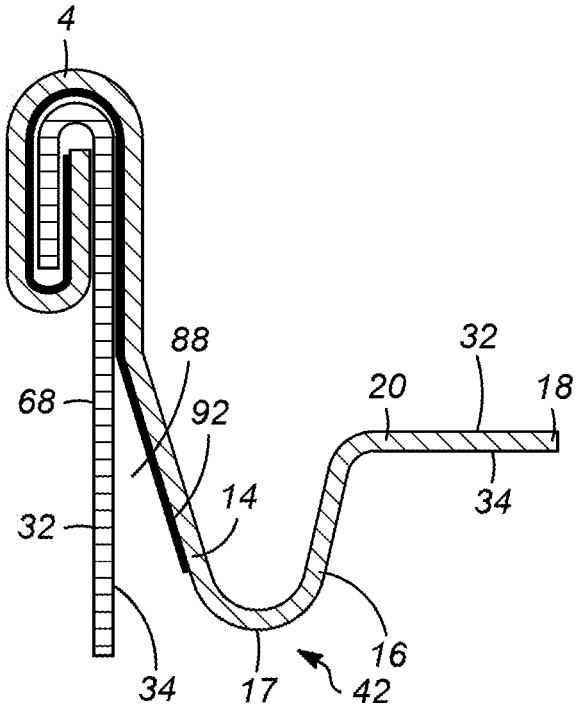
FIG. 6 is a partial cross-sectional view of a double seamed beverage container showing a sealing compound extending into a gap between the product sides of a can end and a can body.

Referring to FIGS. 3 and 4, containers 1 of the present invention are generally of a two-piece construction. A can end 10 or lid is attached to a can body 40 in the seaming process described above. The can ends 10 are attached by a seam, preferably a double seam 4 to the can body 40.

As shown in FIGS. 3 and 4, typical can ends 10 for fermented beverage containers have a circumferential curl 12, a circumferential chuckwall 14, a generally U-shaped circumferential countersink 16, and a center or central panel wall 18 extending radially outwardly from a central longitudinal axis The can end 10 is joined to the can body 40 by the curl 12 which is joined to a mating flange of the can body 40. The seaming curl 12 of the can end 10 is integral with the chuckwall 14 which is joined to a radially outer peripheral edge portion 20 of the center panel 18 by the countersink 16. This type of means for joining the can end 10 to a can body 40 is presently the typical means for joining used in the industry. The curl 12 terminates at a cutedge 13 of the metal used to form the can end 10.

Figure 2:
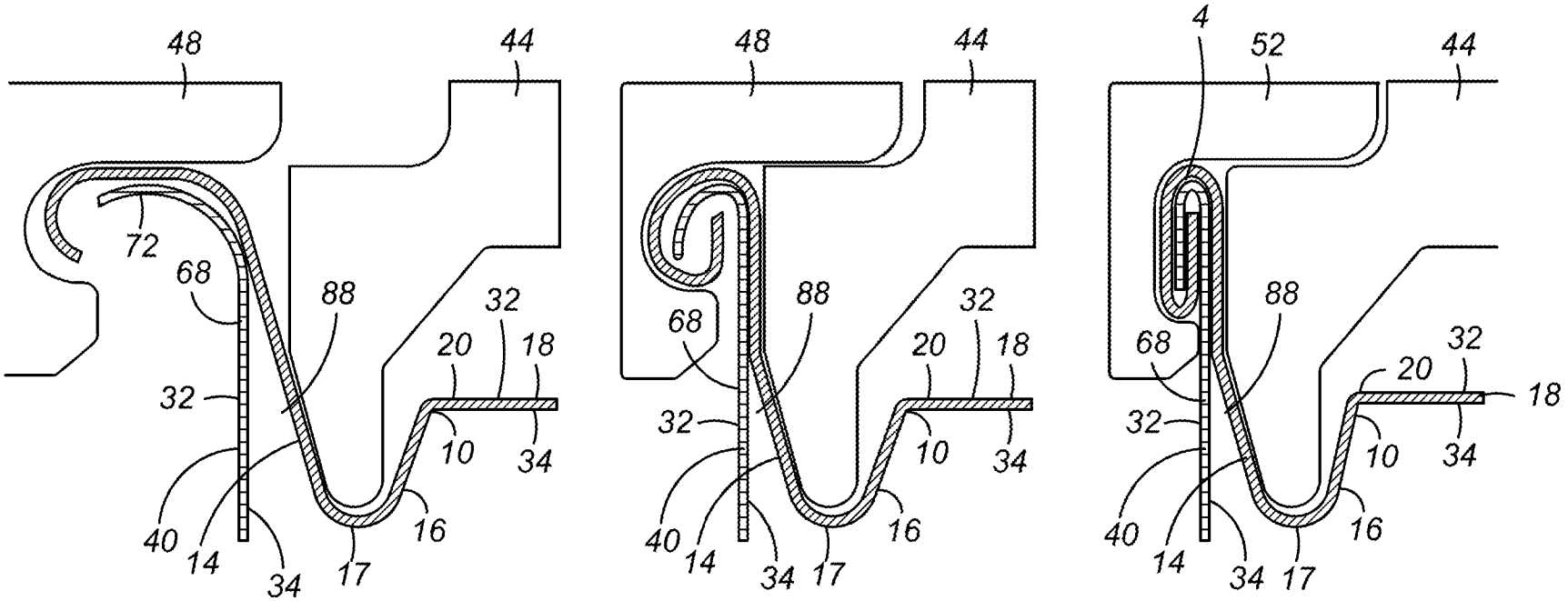
FIG. 2 is a magnified partial side view of a seaming operation.

The center panel 18 has a means for opening the end 10. The means for opening the end 10 may include a displaceable closure member such as a membrane or thin foil or, as shown in FIGS. 2 and 3, a tear panel 22 defined by a curvilinear frangible score 24 and a non-frangible hinge segment 26. The hinge segment 26 is defined by a generally straight line between a first end and a second end of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection as it is opened by being displaced away from the plane of the panel 18.

The frangible score 24 is preferably a generally V-shaped groove formed into a public side 32 of the center panel 18. A residual is formed between the V-shaped groove and a product side 34 of the end member 10.

The illustrated opening means has a tab 28 secured to the center panel 18 adjacent the tear panel 22 by a rivet 38. The rivet 38 is formed in the typical manner. Often, and as illustrated, the opening means is recessed within a deboss panel.

The curvilinear countersink 16 is located about the peripheral edge 20 of the center panel 18. Accordingly, the countersink 16 extends circumferentially about the center panel 18. The countersink 16 extends radially outwardly from the peripheral edge 20 of the center panel 18 and joins the center panel 18 with the chuckwall 14.

The countersink 16 is generally U-shaped. Here, generally U-shaped is intended to encompass a structure having a concave bead 17 as viewed from the public side 32. This concave bead 17 has a portion which defines the lowermost extent of the can end 10.

The chuckwall 14 joins the countersink 16 with the curl 12 so that an uppermost portion of the chuckwall 14 is directly connected to the curl 12 and a lowermost portion of the chuckwall 14 is directly connected to the countersink 16. Accordingly, the chuckwall 14 extends upwardly from the countersink 16. The chuckwall 14 may be angled outwardly relative to the longitudinal axis 50 or have an arcuate segment.

These types of can ends 10 have been used for many years, with a large majority of such ends in use today being the "ecology" or "stay-on-tab" ("SOT") ends in which the tab 28 remains attached to the end after a tear panel 22, including large-opening ends ("LOE"), is opened. In an LOE, the pour opening is about 0.5 square inches in area.

Again, these can ends 10 are typically manufactured from a sheet of a metal substrate, such as aluminum, tin plated steel, or tin free steel. The metal sheet may have a cured protective coating on the upper and lower surfaces, i.e. the public and product sides 34, such as epoxies, acrylic epoxies, polyolefin dispersions, and polyethylene laminates. The protective coating protects the metal of the can end 10 from corrosion, either during processing or during storage of the packaged product. Any oxidation, corrosion or rust on the surface of the can end 10 is unacceptable to can manufacturers in general.

A can body 40 has a lower portion and an upper portion. When seamed to a can end 10, the product sides 34 of the upper and lower portions of the can body 40 together with the product side of the can end create a containment space 42 (see, e.g., FIG. 3) for holding a liquid beverage. The lower portion includes an enclosed bottom 56 and a cylindrical sidewall 60 extending upwardly from the enclosed bottom 56 portion.

According to FIG. 1, the bottom 56 has a dome-shaped center panel surround by a generally a circumferential annular support. An outer wall extends radially outwardly and upwardly relative to the annular support and joins the bottom 56 with the lowermost portion of the cylindrical sidewall 60.

The cylindrical sidewall 60 is centered about the longitudinal axis 50. In the embodiments illustrated the sidewall 60 is smooth and flat. However, one of ordinary skill in the art would appreciate that any one of a number of forming techniques could be employed to impart a shape and/or texture to the sidewall 60. For instance, the interior of the sidewall 60 could be forced outwardly by a fluid pressure or forming segments, laser treatment could be employed to etch or otherwise mark the sidewall 60, and/or flutes or other designs may be imparted onto the sidewall 60 through mechanical deformation of the sidewall 60.

The upper portion includes a circumferential shoulder 64 portion. The shoulder 64 has a convexly curved appearance when viewed from the public side 32 of the container 1. The shoulder 64 has a lowermost point integral with an uppermost portion of the cylindrical sidewall. The transition point between the sidewall 60 and shoulder 64 is at a point where the can body 40 begins to curve radially inwardly. Stated another way, the diameter of the can body 40 begins to decrease at the point where the shoulder 64 begins and the sidewall 60 ends.

The upper portion further includes a neck 68. The neck 68 has a lowermost portion integral with an uppermost portion of the shoulder 64. The neck 68 is preferentially substantially flat, i.e. primarily free of an arc-shape design, although it may have some discontinuity formed during production. A diameter of the can body 40 in the neck 68 is relatively constant.

The upper portion also includes a radially outwardly extending flange 72 located above the neck 68. This flange 72 is integral with an uppermost portion of the neck 68. The flange 72 has a convex appearance when viewed from a vantage point above the can body 40, i.e. looking down at the open end of the can body 40.

Like the can ends 10, can bodies 40 may have a cured protective coating 76 on the public and product sides 32,34. The protective coating 76 protects the metal of the can bodies 40 from corrosion, either during processing or during storage of the packaged product. It is significant to note that in a typical can body 40 manufacturing process, the shoulder 64, neck 68, and flange 72 are generally formed on a semi-finished can body 40 subsequent to the coating 76 being added to the product side 34 of the can body 40.

Figure 7:
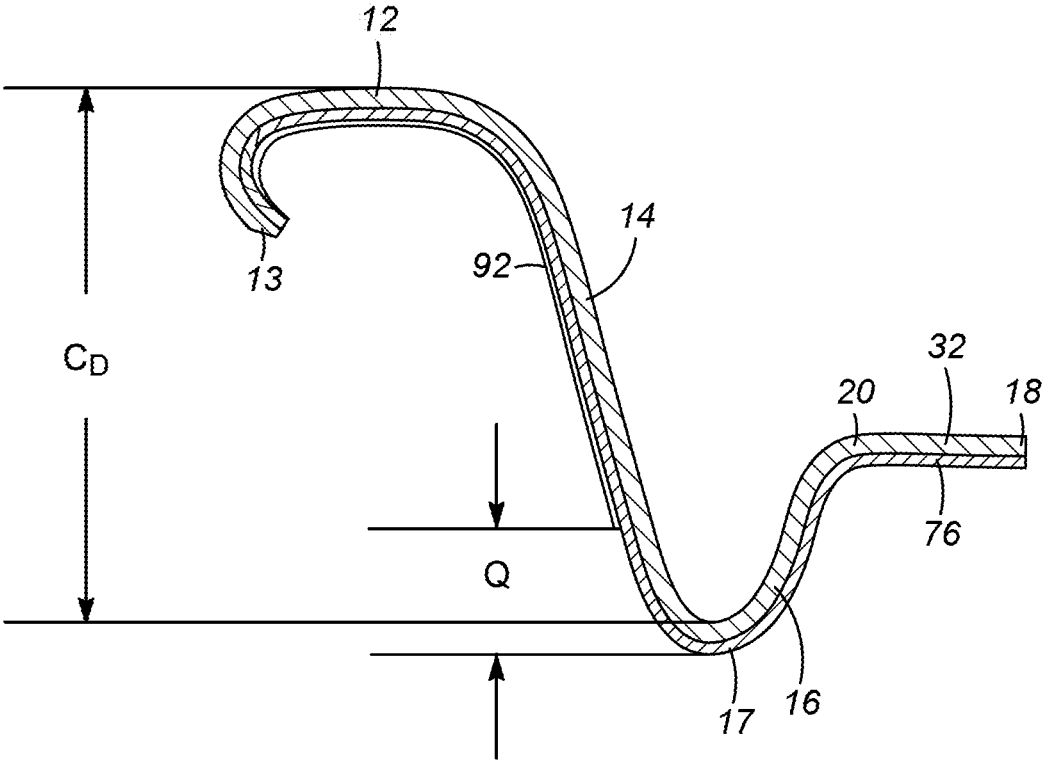
FIG. 7 is a partial cross-sectional view of a can end showing a cured organic coating forming a substantially continuous film on the product side of the can end and a sealing compound extending down a chuckwall and terminating at a height greater than a lowermost vertical extent of the can end.
Figure 9:
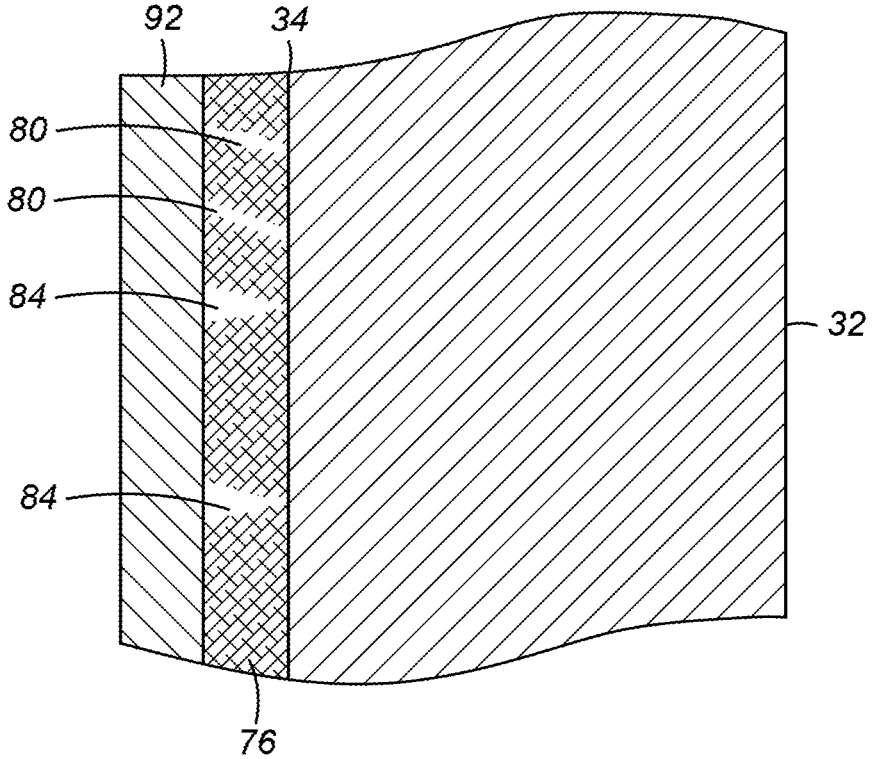
FIG. 9 is a highly magnified cross-section of a container component a sealing compound forming a protective barrier over the fractures and bare metal showing through voids.

As previously explained, the can end 10 has a cured coating 76 on the product side 34 which forms a substantially continuous thin film or layer thereon (see, e.g. FIG. 7). This cured coating 76 is generally applied prior to the seaming operation. Forming, handling, and the seaming operation may cause fractures 80 in the cured coating 76 (see, e.g., FIG. 9). In many cases, the fractures 80 cause a weakening of the cured coating 76. In other instances, the fractures 80 can expose bare metal through voids 84 in the cured coating 76 of the product side 34 of the can end 10. These fractures 80 in the cured coating 76 can extend down the chuckwall 14 almost to the lowermost vertical extent of the can end 10 defined by the bead 17 of the countersink 16.

Figure 8:
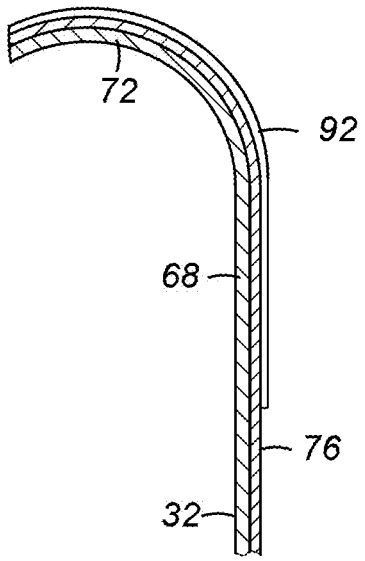
FIG. 8 is a partial cross-sectional view of a can body showing a cured organic coating forming a substantially continuous film on the product side of the can body and a sealing compound extending down the neck and terminating at a height greater than an uppermost vertical extent of a shoulder of the can body.

Likewise, the can body 40 has a similar cured coating 76 on the product side 34 (see, e.g., FIG. 8). This cured coating 76 also forms a substantially continuous thin layer on the product side 34 of the can body 40. The cured coating 76 is generally applied prior to the seaming operation and prior to the necking and flanging operation. The cured coating isolates the aluminum from the tooling to prevent galling. Again, forming, handling, and the seaming operation may cause fractures 80 in this cured coating 76 as well (see, e.g., FIG. 9). In many cases, the fractures 80 cause a weakening of the cured coating 76. In other instances, the fractures 80 can cause voids 84 exposing bare metal of the product side 34 of the can body 40. These fractures 80 in the cured coating 76 can extend past the flange 72 into the neck 68 of the can body 40.

Figure 11:
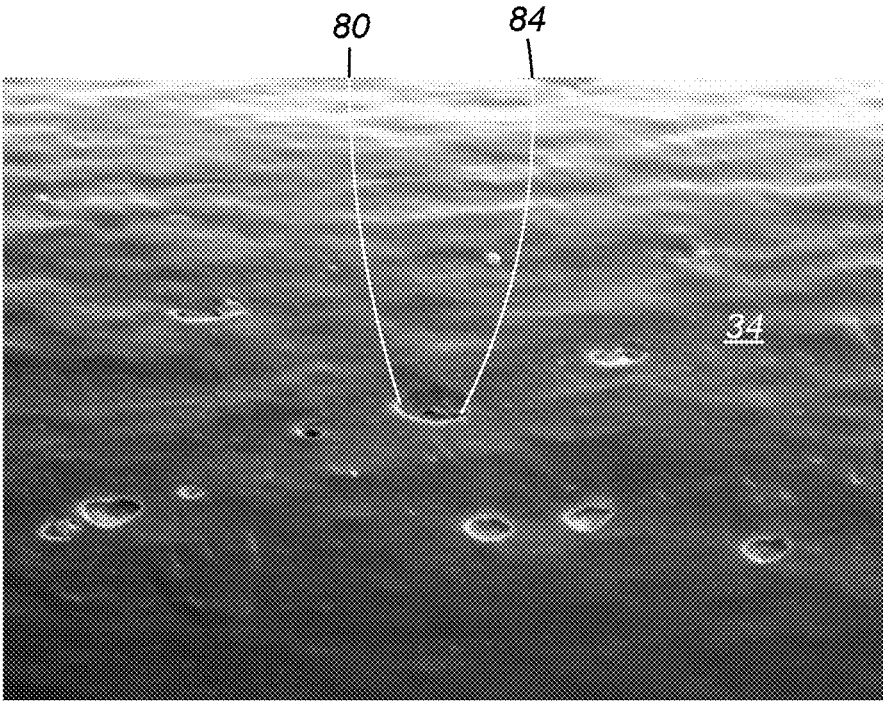
FIGS. 11 and 12 are views of a product side of container components showing fractures in a cure protective coating.
Figure 12:
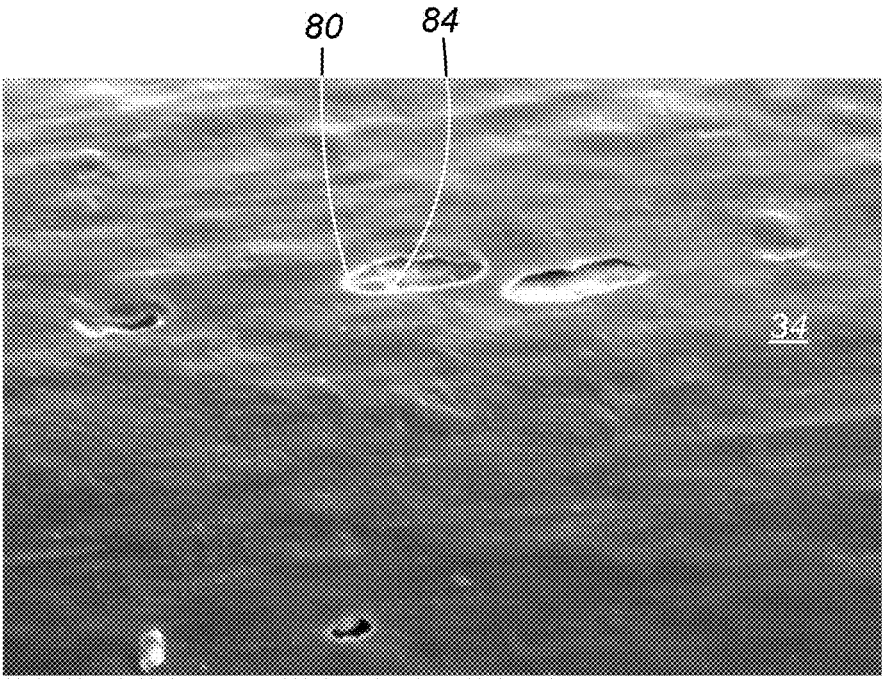
Figure 13:
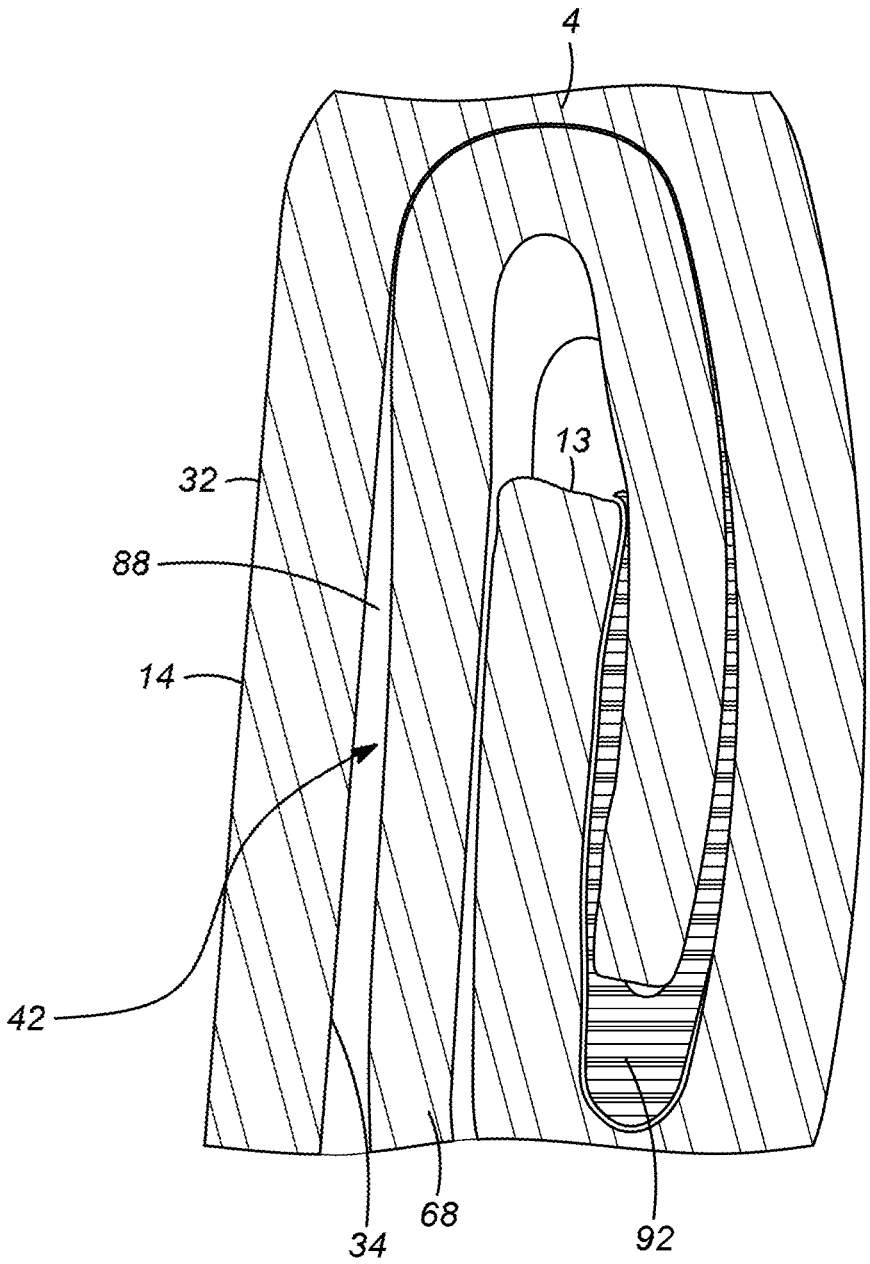
FIG. 13 (Prior Art)
FIG. 13 is a magnified view of a double seam of a prior art container showing a sealing compound terminating in the double seam and not extending into a gap between product sides of a can body and a can end.

Examples of the cured coating 76 damage is illustrated in the magnified photographs reproduced as FIGS. 11 and 12.

Figure 14:
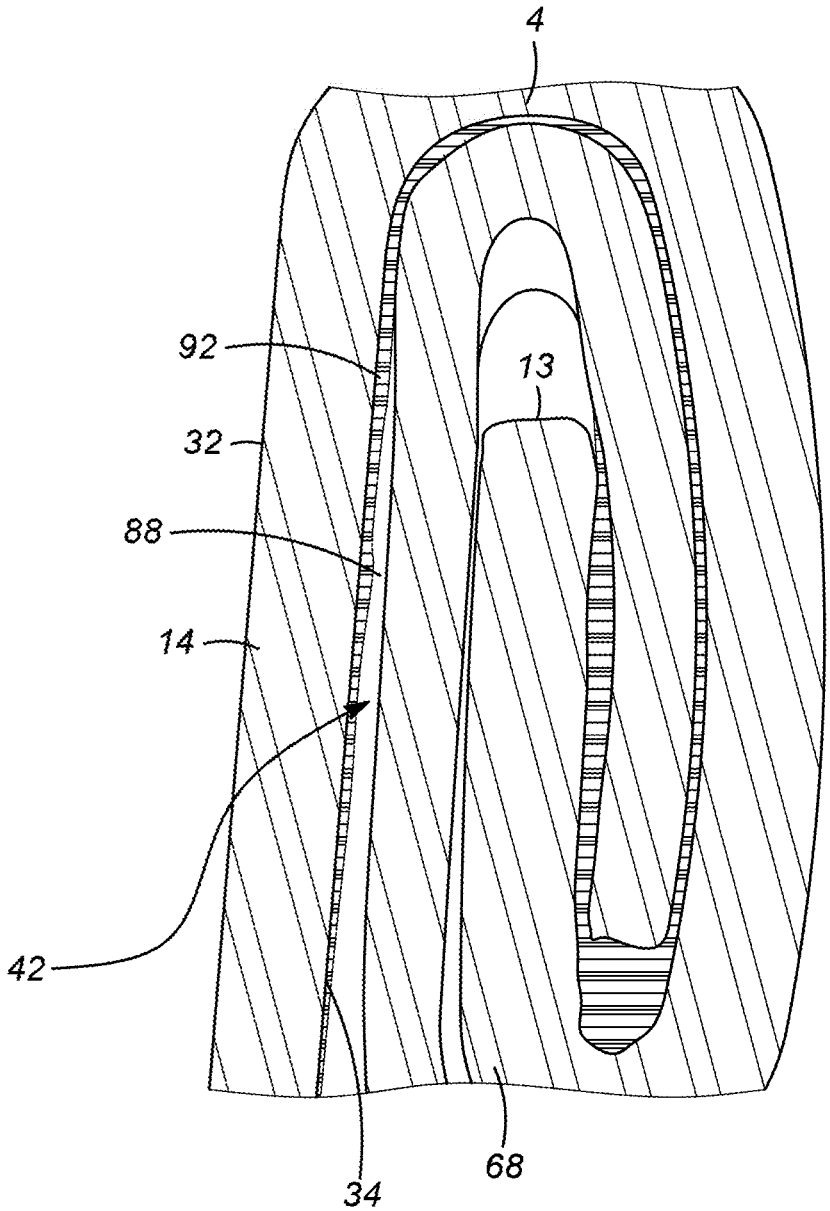
FIG. 14 is a magnified view of a double seam of a container of the present invention showing a sealing compound extending into a gap between product sides of a can body and a can end and having a terminating end within the gap.

In a filled beverage container 1, the can end 10 is seamed to the can body 40 forming the double seam 4. There is a small gap 88 between the can end 10 and the can body 40 within the containment space 42 of the container 1 and located radially inwardly from the double seam 4 relative to the longitudinal axis 50 about which the beverage container 1 is centered and extending below the double seam 4 (see, e.g. FIG. 14). An uppermost portion of the containment space 42 is defined by a region of the beverage container 1 located radially inwardly from the double seam 4 where the product side 34 of the can body 10 and the product side 34 of the can end 10 begin to diverge from one another, creating the gap 88. This gap 88 forms a distance between the product side 34 of the can end 10 and the product side 34 of the can body 40. A second coating, generally a sealing compound 92, is located between the product side 34 of the can end 10 and the product side 34 of the can body 40. The sealing compound 92 is placed or located on at least one of the can end 10 and the can body 40. The sealing compound extends into the gap 88 as illustrated in FIG. 14.

The sealing compound 92 creates a protective layer on fractures 80 in the cured coatings 76 on the product sides 34 of the can end 10 and can body 40. Voids 84 created by the fractures 80 in the cured coatings 76 expose bare metal in the can end 10 and can body 40. The voids are covered by the protective layer to prevent direct contact of a beverage in the containment space 42 with the bare metal of the container 1. The sealing compound has a weight greater than 18 mg. More preferably, the sealing compound 92 weight is between 18 mg and 32 mg. Most preferably, the sealing compound 92 weight is between 24 mg and 32 mg.

Figure 10A:
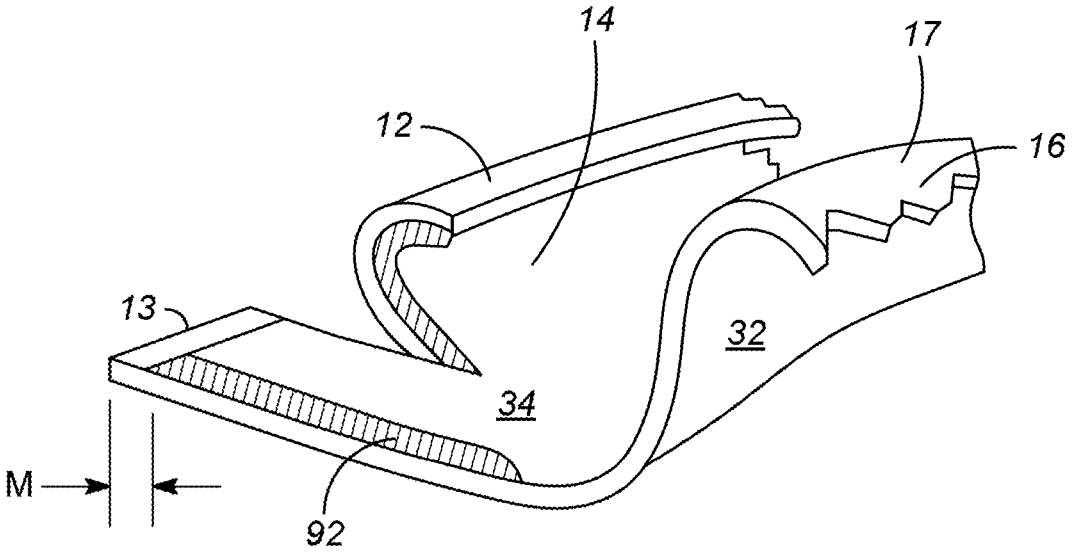
FIG. 10A (Prior Art)
FIG. 10A is a partial schematic view showing a prior art uncurled can end curl to a countersink with a sealing compound deposited thereon.
Figure 10B:
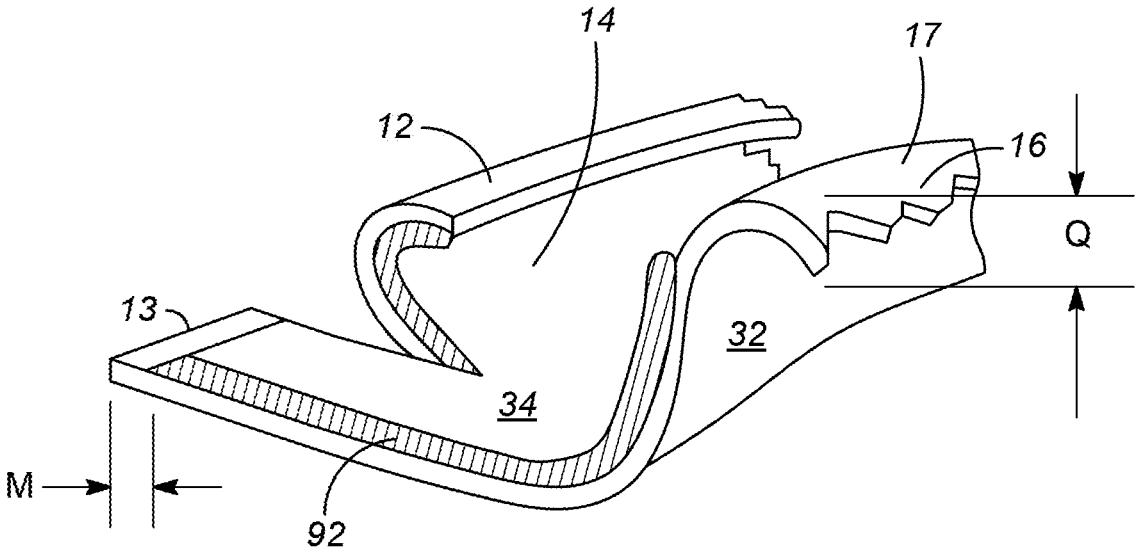
FIG. 10B is a partial schematic view showing a can end of the present invention showing an uncurled can end curl to a countersink with a sealing compound deposited thereon.

As applied to can end 10, the sealing compound 92 extends from the curl 12 downwardly on the chuckwall 14 towards the countersink 16. It terminates at a height Q on the can end 10 greater than the lowermost vertical extent of the can end 10 (see, e.g., FIGS. 7 and 10B). Preferably, the height Q on the can end 10 that is no greater than 6 mm above the lowermost vertical extent of the product side of the can end 10. More preferably, the sealing compound 92 terminates at a height Q on the can end 10 between 5 mm and 6 mm above the lowermost vertical extent of the product side of the can end 10. Most preferably, the sealing compound 92 terminates at a height Q on the can end 10 between 5.25 mm and 5.6 mm above the lowermost vertical extent of the product side of the can end 10.

The sealing compound 92 is generally applied just prior to seaming to a spinning can end 10 and centripetal force distributes the sealing compound 92 as required. The typical seaming operation spins at 3000-4000 RPM. The inventors contemplate varying the rotational velocity of the can end 10 during sealing compound 92 application. The inventors have discovered that a viscosity of the uncured/undried sealing compound 92 is important to get the sealing compound 92 into the correct location between the can end 10 and can body 40.

As illustrated in, for example, FIG. 14, the sealing compound 92 is applied FCCSS such that it covers exposed metal on the can body flange 72 and the product side of the curl 12

In one embodiment, a can end 10 has a countersink depth CD measured from an uppermost vertical extent of the curl 12 to the public side 32 of a lowermost vertical extent of the countersink 16. The terminating height Q of the sealing compound above the lowermost vertical extent of the product side of the can end 10 is 75% to 90 of the countersink depth CD. (See FIG. 7).

The sealing compound 92 on the can end 10 is circumferential. It forms a ring about a portion of the curl 12 and the chuckwall 14. Thus, the sealing compound 92 forms a circumferential layer or liner on the cured protective coating.

As applied to the can body 40 (see, e.g. FIG. 8), the sealing compound 92 forms a circumferential layer or liner on the flange 72 and extends downwardly on the neck 68. The sealing compound 92 terminates above the shoulder 64.

It should be noted that the sealing compound 92 can be applied to one or both of the can body 40 and the can end 10. The sealing compound 92 preferably provides the protective coating over the damages or fractured cured organic coatings on the product sides 34 of the can end 10 and can body 40. It follows that adequate coverage by the sealing compound 92 can be expressed in relation to a filled and seamed beverage container 1.

For example, the sealing compound 92 extends into the gap 88 and terminates at a height Q greater than a lowermost vertical extent of the can end 10. Preferably, the sealing compound 92 terminates within the gap 88 at a height Q no greater than 6 mm above the lowermost vertical extent of the can end 10, more preferably terminating within the gap 88 at a height Q between 5 mm and 6 mm above the lowermost vertical extent of the can end 10, and most preferably terminating within the gap 88 at a height Q between 5.25 mm and 5.6 mm above the lowermost vertical extent of the can end 10.

Further, the sealing compound 92 within the beverage container 1 can be described in relation to the can body 40. For example, the sealing compound 92 can extend into the gap 88 and terminate at a height Q greater than an uppermost extent of the can body 40 shoulder 64.

In a method sealing a fermented beverage in a metallic beverage container. A metallic can end 10 comprising a curl 12 defining an outer perimeter of the can end 10 is provided. The can end 10 has a first cured coating 76 forming a resilient film on the product side 34 of the can end 10. A metallic can body 40 comprising a flange 72 about an open end has a second cured coating 76 forming a resilient film on the product side 34 of the can body 40. A flowable sealing compound 92 is applied between the can end 10 and the can body 12. The can end 10 is attached to the can body 40 by a double seam 4 wherein the flowable sealing compound 92 is located within the double seam 4 and extends into a gap 88 created by a space between the product sides 34 of the can body 10 and the can end 40.

Embodiments of the invention includes the parameters set forth in Table 1:

| Sealing Compound Placement | | |
|---|---|---|
| Distance from cut edge: M | 1.0 mm | ±0.5 mm |
| Compound Termination Height: Q | 5.6 mm | ±0.5 mm |
| Compound weight | 24 mg | ±5 mg |
| Distance from cut edge: M | 0.7 mm | ±0.5 mm |
| Compound Termination Height: Q | 5.3 mm | ±0.5 mm |
| Compound weight | 24 mg | ±5 mg |
| Distance from cut edge: M | 1.0 mm | ±0.5 mm |
| Compound Termination Height: Q | 5.25 mm | ±0.6 mm |
| Compound weight | 32 mg | ±5 mg |

ILLUSTRATIVE EXAMPLE

Containers formed from can bodies filled with a known problematic wine dosed with a concentration of $SO_2$ and enclosed with FCCSS can ends according to the present invention were produced and compared to prior art containers filled with the same problematic wine. The shelf life of the containers was determined by sensory (flavor and aroma) testing performed by sensory panelists. The FCCSS containers exhibited +50% shelf-life over the prior art can ends.

Figure 15:
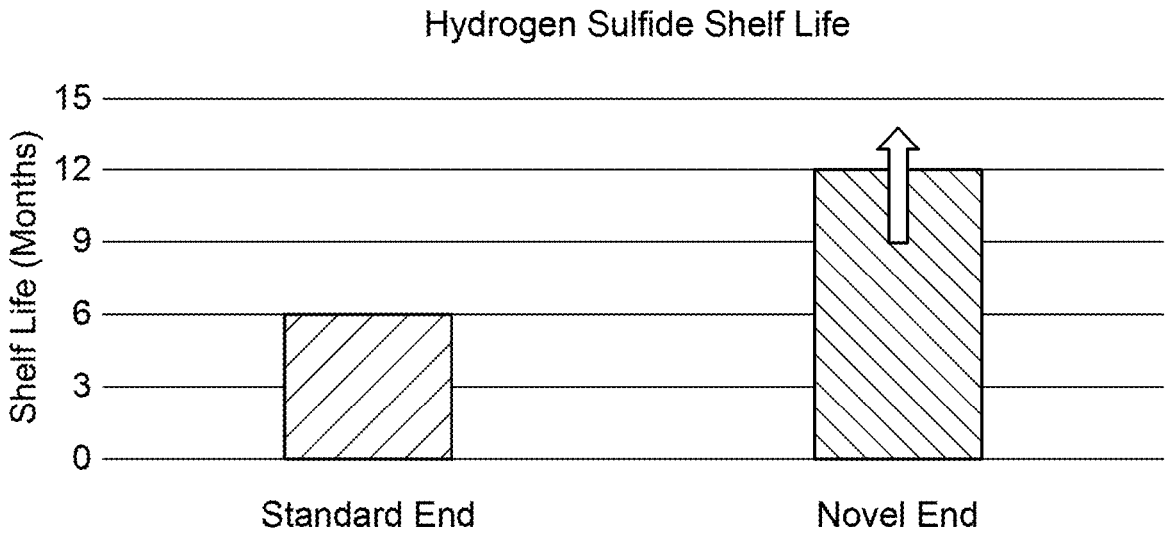
FIG. 15 is a bar graph comparison of the shelf life of a prior art end compared to the shelf life of an end produced according to the present disclosure.
Figure 16:
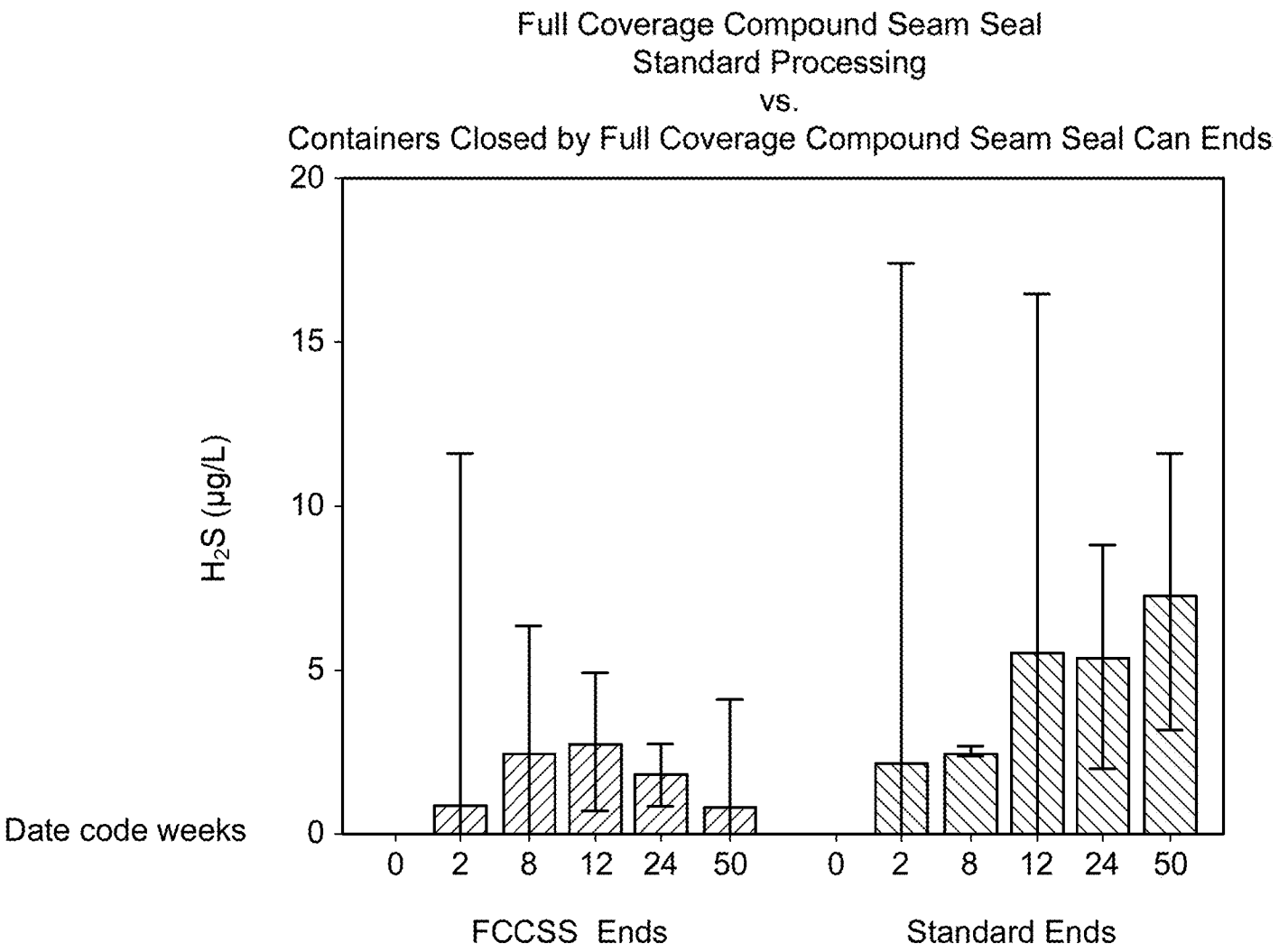
FIG. 16 is a bar graph comparison of a $H_2S$ concentration in μg/liter after 0, 2, 8, 12, 24 and 50 weeks in containers having a can end with a full coverage compound seam seal of the present invention versus container having a prior art can end.
Figure 17:
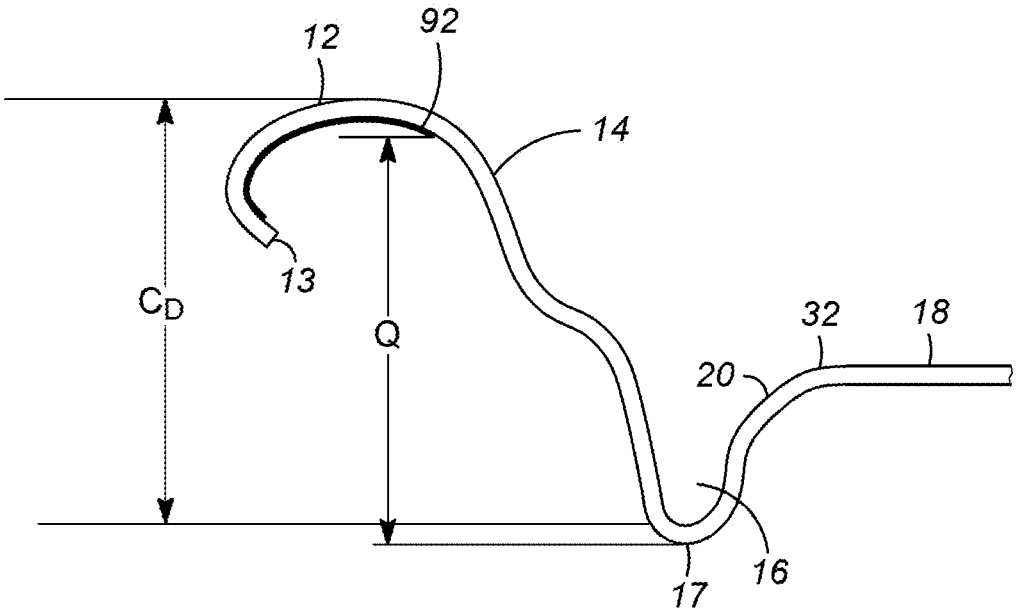
FIG. 17 (Prior Art)
FIG. 17 is a can end showing a prior art compound liner terminating with the curl and short of the chuckwall.
Figure 18:
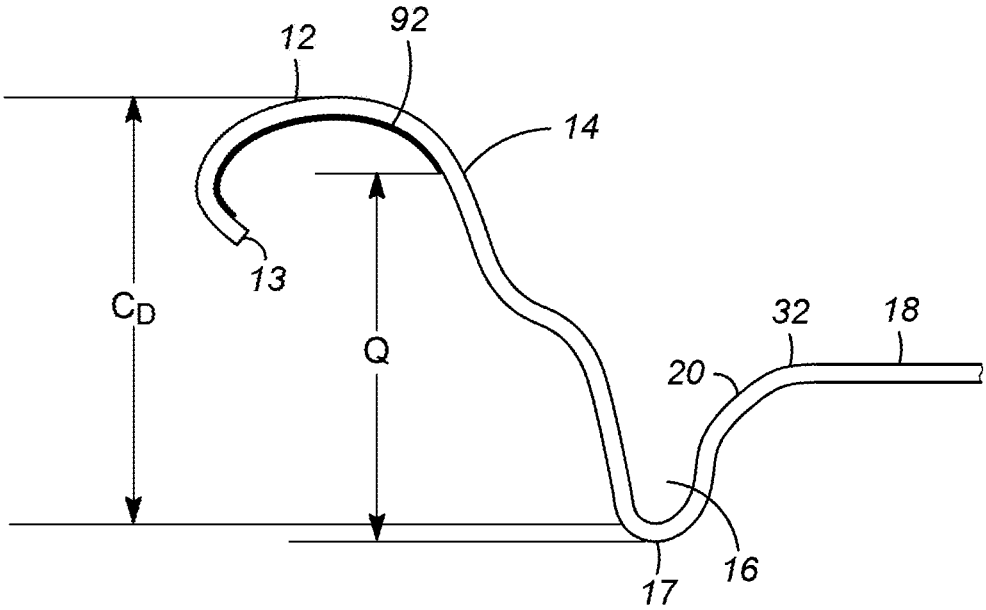
FIG. 18 is a can end showing a compound liner improvement of the present invention with a full coverage compound seam seal (FCCSS) position extending from a seaming curl to a chuckwall.

As illustrated in FIGS. 15 and 16, it was determined that containers produced according to the present invention result in a 50% increase in shelf life.

Further, damage (i.e. metal exposure) occurring during attachment of FCCSS can ends onto filled can bodies during double seaming was reduced 50% by the implementing the principles of the present disclosure.

Further, by the implementing the principles of the present disclosure, the time required to reach an unacceptable $H_2S$ sensory threshold increased by more than 3 months.

While the specific embodiments have been illustrated and described, numerous modifications come to mind without significantly departing from the spirit of the invention, and the scope of protection is only limited by the scope of the accompanying Claims.

What is claimed is:

1. A can end (10) for a two-piece beverage container (1), the can end (10) comprising:
- a public side (32) opposite a product side (34);
- a cured coating (76) on the product side (34) of the can end (10) forming a substantially continuous thin layer thereon;
- a circumferential curl (12) centered about a longitudinal axis (50);
- a circumferential chuckwall (14) extending downwardly from the curl (12);
- a circumferential U-shaped countersink (16) located downwardly from the chuckwall (14), the countersink (16) having an annular bead defining a lowermost vertical extent of the can end (10);
- a center panel (18) located radially inwardly from the countersink (16) and centered about the longitudinal axis (50), the center panel (18) comprising a means for providing an opening in the can end (10); and
- a circumferential second coating (92) forming an annular layer on the product side (34) of the circumferential curl (12) and the cured coating (76), the second coating (92) providing a layer on one or more fractures in the cured coating (76),
- wherein the second coating (92) extends from the curl (12) downwardly on the chuckwall (14) towards the countersink (16) and terminates at a height on the can end (10) greater than a lowermost vertical extent of the can end (10),
- wherein the second coating (92) terminates at a height on the can end (10) that is no greater than 6 mm above the lowermost vertical extent of the can end (10),
- wherein the one or more fractures are covered by the second coating (92) to prevent direct contact of a beverage with a bare metal of the can end (10).

2. The can end (10) of claim 1 wherein the second coating (92) terminates at a height on the can end (10) between 5 mm and 6 mm above the lowermost vertical extent of the can end (10).

3. The can end (10) of claim 1 wherein the second coating (92) terminates at a height on the can end (10) between 5.25 mm and 5.6 mm above the lowermost vertical extent of the can end (10).

4. The can end (10) of claim 1 wherein the can end (10) has a countersink (16) depth measured from an uppermost vertical extent of the curl (12) to the public side (32) of a lowermost vertical extent of the countersink (16), and the second coating (92) terminates at a height above the lowermost vertical extent of the product side (34) of the can end (10) is 75% to 90 of the countersink (16) depth.

5. The can end (10) of claim 1 wherein the second coating (92) is a sealing compound (92) applied to the can end (10) subsequent to forming and prior to seaming the can end (10) to a can body (40).

6. The can end (10) of claim 1 wherein the one or more fractures create a void which exposes the bare metal through the cured coating (76).

7. The can end (10) of claim 1 wherein the cured coating (76) is an organic coating.

8. The can end (10) of claim 1 wherein the second coating (92) has a weight greater than 18 mg.

9. The can end (10) of claim 1 wherein the second coating (92) has a weight between 18 mg and 32 mg.

10. The can end (10) of claim 1 wherein the second coating (92) has a weight between 24 mg and 32 mg.

11. The can end (10) of claim 1 wherein the can end (10) is produced from aluminum.

12. A beverage container (1) comprising:
- a metallic can end (10) comprising a curl (12) defining an outer perimeter of the can end (10), the can end (10) having a product side (34) opposite a public side (32);
- a metallic can body (40) comprising a flange about an open end, the can body (40) also having a product side (34) opposite a public side (32), wherein the curl (12) of metallic can end (10) is seamed with the flange to form a double seam enclosing the beverage container (1);
- a containment space formed by the product side of the can end and the product side of the can body, the containment space for holding a beverage;

a gap (88) between the can end (10) and can body (40) below the double seam forming a distance between the product side (34) of the can end (10) and the product side (34) of the can body (40); and a sealing compound (92) on at least one of the can end (10) and the can body (40) and extending into the gap (88) within the containment space where the product side (34) of the can body (40) and the product side (34) of the can end (10) begin to diverge from one another, wherein the can end (10) comprises a circumferential U-shaped countersink (16) located downwardly from the curl (12), the countersink (16) having an annular bead defining a lowermost vertical extent of the can end (10), wherein the sealing compound (92) extends into the gap (88) and terminates at a height greater than a lowermost vertical extent of the can end (10).

13. The beverage container (1) of claim 12 wherein the sealing compound (92) terminates within the gap (88) at a height no greater than 6 mm above the lowermost vertical extent of the can end (10).

14. The beverage container (1) of claim 13 wherein the sealing compound (92) terminates within the gap (88) at a height between 5 mm and 6 mm above the lowermost vertical extent of the can end (10).

15. The beverage container (1) of claim 14 wherein the sealing compound (92) terminates within the gap (88) at a height between 5.25 mm and 5.6 mm above the lowermost vertical extent of the can end (10).

16. The beverage container (1) of claim 12 wherein the sealing compound (92) is applied to the can end (10) subsequent to forming and prior to seaming the can end (10) to a can body (40).

17. A beverage container (1) comprising:

a metallic can end (10) comprising a curl (12) defining an outer perimeter of the can end (10), the can end (10) having a product side (34) opposite a public side (32);

a metallic can body (40) comprising a flange about an open end, the can body (40) also having a product side (34) opposite a public side (32), wherein the curl (12) of metallic can end (10) is seamed with the flange to form a double seam enclosing the beverage container (1);

a gap (88) between the can end (10) and can body (40) below the double seam forming a distance between the product side (34) of the can end (10) and the product side (34) of the can body (40); and a sealing compound (92) on at least one of the can end (10) and the can body (40) and extending into the gap (88), wherein the can end (10) comprises a circumferential U-shaped countersink (16) located downwardly from the curl (12), the countersink (16) having an annular bead defining a lowermost vertical extent of the can end (10), wherein the sealing compound (92) extends into the gap (88) and terminates at a height greater than a lowermost vertical extent of the can end (10), wherein the sealing compound (92) provides a layer on one or more fractures in a cured coating (76) on at least one of the can end (10) and the can body (40).

18. The beverage container (1) of claim 17 wherein the one or more fractures create a void which exposes a bare metal to the sealing compound (92).

19. The beverage container (1) of claim 18 wherein the cured coating (76) is an organic coating.

20. The beverage container (1) of claim 19 wherein the sealing compound (92) has a weight greater than 18 mg.

21. The beverage container (1) of claim 20 wherein sealing compound (92) weight is between 18 mg and 32 mg.

22. The beverage container (1) of claim 21 wherein sealing compound (92) weight is between 24 mg and 32 mg.

23. The beverage container (1) of claim 12 wherein the can end (10) has a countersink (16) depth measured from an uppermost vertical extent of the curl (12) to the public side (32) of a lowermost vertical extent of the countersink (16), and the sealing compound (92) terminates at a height above the lowermost vertical extent of the product side (34) of the can end (10) that is 75% to 90 of the countersink (16) depth.

24. The beverage container (1) of claim 12 wherein the can end (10) and the can body (40) are produced from aluminum.

25. The beverage container (1) of claim 12 wherein the gap (88) is located radially inwardly from the double seam relative to a longitudinal axis (50) about which the beverage container (1) is centered.

26. The beverage container (1) of claim 25 wherein an uppermost portion of the containment space (42) is defined by a region of the beverage container (1) located radially inwardly from the double seam where the product side (34) of the can body (40) and the product side (34) of the can end (10) begin to diverge from one another.

27. The beverage container (1) of claim 12 wherein a fermented beverage is stored within a containment space (42) of the beverage container (1).

28. The beverage container (1) of claim 12 wherein the fermented beverage is a wine produced from grapes.

* * * * *